US009511921B2

(12) United States Patent
Crowe et al.

(10) Patent No.: US 9,511,921 B2
(45) Date of Patent: Dec. 6, 2016

(54) HEATED UTILITY BAG

(71) Applicant: Milwaukee Electric Tool Corporation, Brookfield, WI (US)

(72) Inventors: Jason R. Crowe, Seattle, WA (US); Douglas G. Schwartz, West Bend, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 107 days.

(21) Appl. No.: 14/216,577

(22) Filed: Mar. 17, 2014

(65) Prior Publication Data

US 2014/0262861 A1 Sep. 18, 2014

Related U.S. Application Data

(60) Provisional application No. 61/789,247, filed on Mar. 15, 2013.

(51) Int. Cl.

| | |
|---|---|
| ***B25H 3/00*** | (2006.01) |
| ***B65D 81/18*** | (2006.01) |
| ***H05B 3/36*** | (2006.01) |
| ***H05B 1/02*** | (2006.01) |

(52) U.S. Cl.

CPC ..... *B65D 81/18* (2013.01); *B25H 3/00* (2013.01); *H05B 1/0227* (2013.01); *H05B 3/36* (2013.01); *H05B 2203/03* (2013.01)

(58) Field of Classification Search

None

See application file for complete search history.

(56) References Cited

U.S. PATENT DOCUMENTS

| | | | | |
|---|---|---|---|---|
| 3,091,681 | A * | 5/1963 | Mayer | A63B 47/005 206/315.91 |
| 4,050,003 | A * | 9/1977 | Owings | B25F 3/00 219/240 |
| 4,523,078 | A * | 6/1985 | Lehmann | A47J 39/02 219/202 |
| 4,926,029 | A | 5/1990 | Pearson | |
| 5,183,994 | A | 2/1993 | Bowles, Sr. et al. | |
| 5,353,600 | A | 10/1994 | Merritt et al. | |
| 5,569,401 | A * | 10/1996 | Gilliland | A47K 10/06 219/386 |
| 5,615,805 | A | 4/1997 | Yoncak | |
| 5,834,738 | A * | 11/1998 | Wilson | A63B 55/00 206/315.3 |
| 5,981,909 | A | 11/1999 | Freeman | |
| 6,018,143 | A | 1/2000 | Check | |
| 6,057,608 | A * | 5/2000 | Bailey, Jr. | B25F 5/02 307/43 |

(Continued)

FOREIGN PATENT DOCUMENTS

| | | | | |
|---|---|---|---|---|
| CA | 2621579 | A1 * | 8/2009 | A45C 15/00 |

*Primary Examiner* — Joseph M Pelham

(74) *Attorney, Agent, or Firm* — Michael Best & Friedrich LLP

(57) ABSTRACT

A utility bag having a frame defining an interior and an exterior, the interior including a first cavity configured to receive an item. The utility bag includes a heater element disposed in the cavity, and a power tool battery pack in electrical communication with the heater element for powering the heater element. The utility bag also includes a pocket coupled to the frame, the pocket defining a second cavity configured to receive the power tool battery pack.

18 Claims, 9 Drawing Sheets

(56) References Cited

U.S. PATENT DOCUMENTS

| | | | | |
|---|---|---|---|---|
| H002093 | H | 1/2004 | Warner et al. | |
| 6,713,727 | B1 | 3/2004 | Johnson | |
| 6,900,416 | B1 | 5/2005 | Erik | |
| 6,947,664 | B1 | 9/2005 | Yeh | |
| 7,170,035 | B2 * | 1/2007 | Peterson | F24C 7/105 206/373 |
| 8,001,803 | B2 | 8/2011 | Kanagaki | |
| 8,067,715 | B2 | 11/2011 | Peterson et al. | |
| 8,168,923 | B2 | 5/2012 | Wong et al. | |
| 2005/0127056 | A1 * | 6/2005 | Petkov | A45C 15/00 219/211 |
| 2007/0193999 | A1 * | 8/2007 | Peterson | F24C 7/105 219/386 |
| 2009/0027005 | A1 * | 1/2009 | Osswald | H02J 7/0042 320/112 |
| 2009/0320516 | A1 | 12/2009 | Kanagaki | |
| 2010/0051599 | A1 * | 3/2010 | DeNitto | H05B 3/34 219/386 |
| 2010/0089902 | A1 | 4/2010 | Wong et al. | |
| 2011/0097017 | A1 | 4/2011 | Abrams | |
| 2012/0189892 | A1 * | 7/2012 | Gilgen | H01M 2/1055 429/99 |
| 2013/0014966 | A1 * | 1/2013 | Tozawa | A01B 33/028 172/48 |
| 2013/0187461 | A1 * | 7/2013 | Goto | A47J 31/005 307/38 |
| 2014/0327401 | A1 * | 11/2014 | Pickens | H02J 7/0042 320/127 |

* cited by examiner

HEATED UTILITY BAG

CROSS-REFERENCE TO RELATED APPLICATION

This application claims priority to U.S. Provisional Patent Application Ser. No. 61/789,247 filed on Mar. 15, 2013, the entire contents of which are incorporated herein by reference.

BACKGROUND

The present invention relates to utility bags and specifically, a heated bag for use with caulk tubes.

Caulk is a flexible sealant for filling cracks, gaps, or joints. While caulk may be applied at a range of temperatures, caulk (and other adhesives) may be applied more easily and may bind more effectively while warm. It may also be advantageous to warm other types of adhesives, materials, working tools, etc.

SUMMARY

In one embodiment, the invention provides a heated utility bag having a structure defining a cavity therein. A wall having a heater mounted thereon is disposed in the cavity. The heater is in electrical communication with a power source.

In another embodiment, the invention provides a utility bag having a frame defining an interior and an exterior, the interior including a first cavity configured to receive an item. The utility bag includes a heater element disposed in the cavity, and a power tool battery pack in electrical communication with the heater element for powering the heater element. The utility bag also includes a pocket coupled to the frame, the pocket defining a second cavity configured to receive the power tool battery pack.

In yet another embodiment, the invention provides a utility bag having a frame defining an interior and an exterior, the interior including a cavity configured to receive an item. The utility bag includes at least one wall dividing the cavity into a plurality of sections, a heater element disposed in the cavity, a battery pack in electrical communication with the heater element for powering the heater element, and a pocket coupled to the frame and disposed exterior of the frame, the pocket defining a second cavity configured to receive the battery.

In yet another embodiment, the invention provides utility bag having a frame defining an interior and an exterior, the interior including a first cavity configured to receive an item. The utility bag includes at least one wall dividing the cavity into a plurality of sections, a heater element disposed in the cavity and coupled to the at least one wall, and a power tool battery pack in electrical communication with the heater element for powering the heater element. The power tool battery pack includes an interface that is substantially shaped and sized to be mechanically and electrically coupled to a power tool. The utility bag also includes a controller configured to distribute power from the power tool battery pack to the heater element in a plurality of modes. The controller is shaped and sized to mechanically and electrically mate with the power tool battery pack, and the controller includes a jack receptacle. The utility bag also includes a control switch for selecting between the plurality of modes. The control switch is coupled to the controller by way of a jack received in the jack receptacle, and the control switch is disposed on the frame. The utility bag also includes a pocket coupled to the frame and disposed exterior of the frame, the pocket defining a second cavity configured to receive the power tool battery pack and the controller.

Other aspects of the invention will become apparent by consideration of the detailed description and accompanying drawings.

Figure 1:
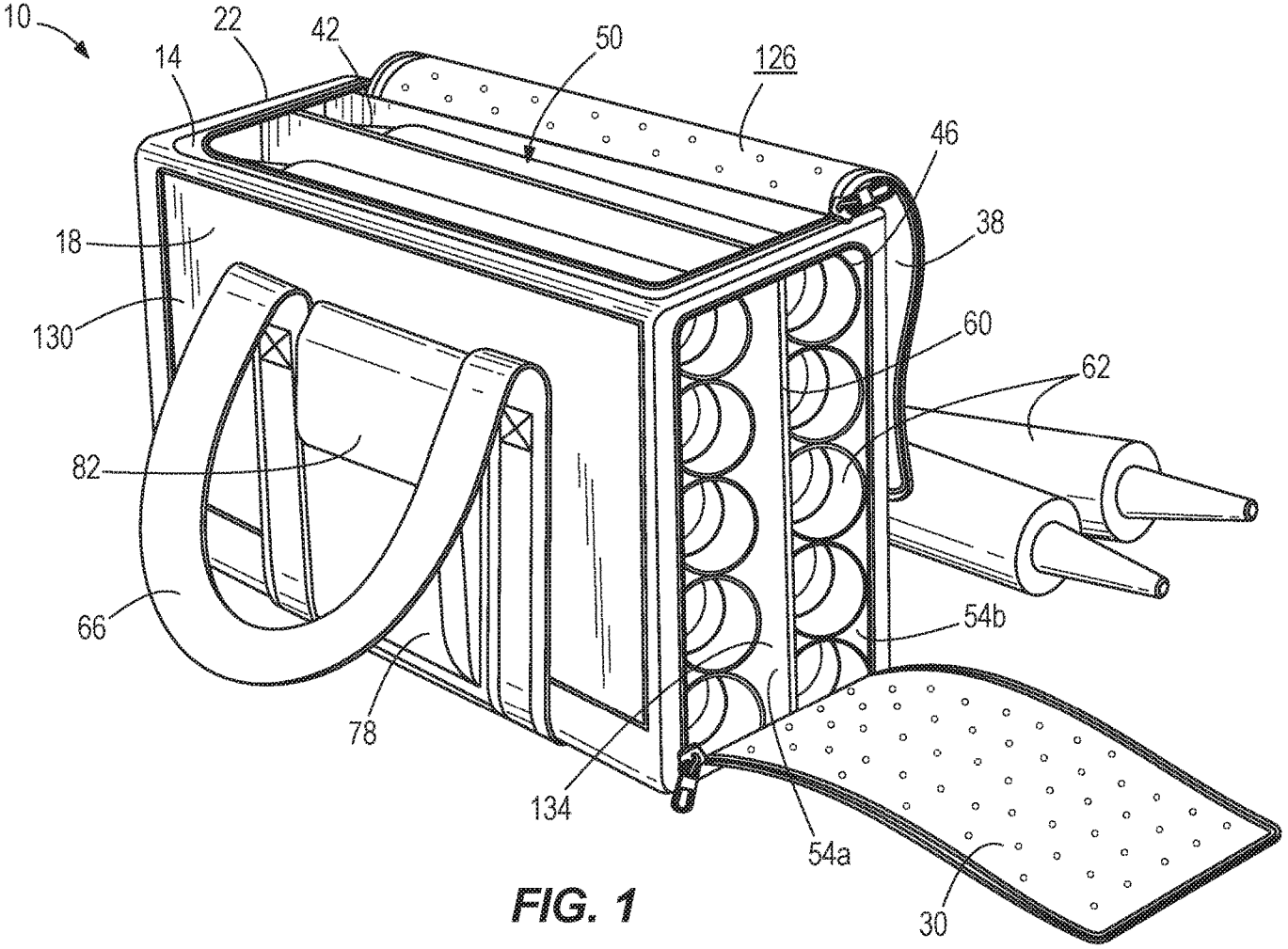
FIG. 1 is a perspective view a heated utility bag according to an embodiment of the invention.
Figures 2A, 2B:
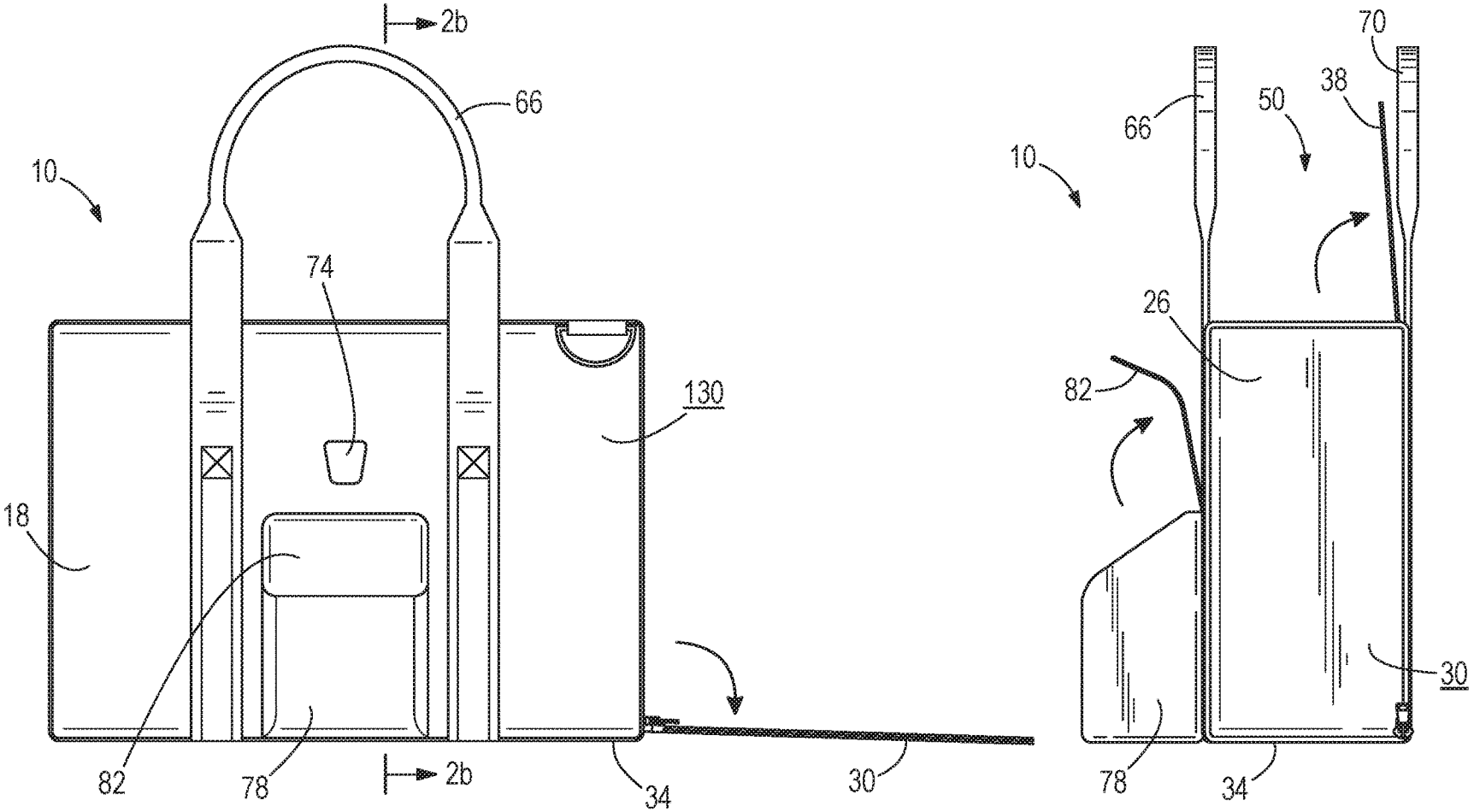
FIG. 2*a* is a front view of the heated utility bag of FIG. 1.
FIG. 2*b* is a side view of the heated utility bag of FIG. 1
Figure 3B:
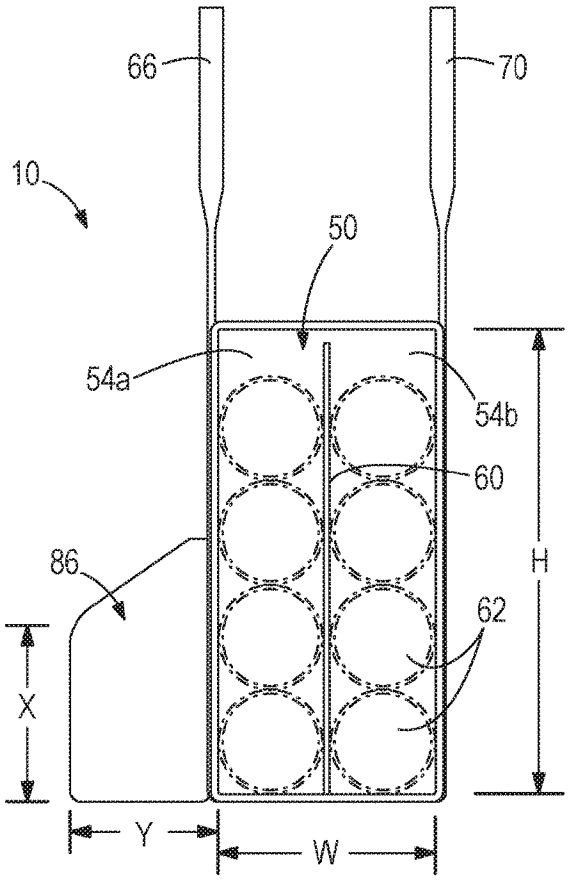
FIG. 3*b* is a schematic cross-sectional view of the heated utility bag of FIG. 1 along line b-b of FIG. 2*a*.
Figure 3A:
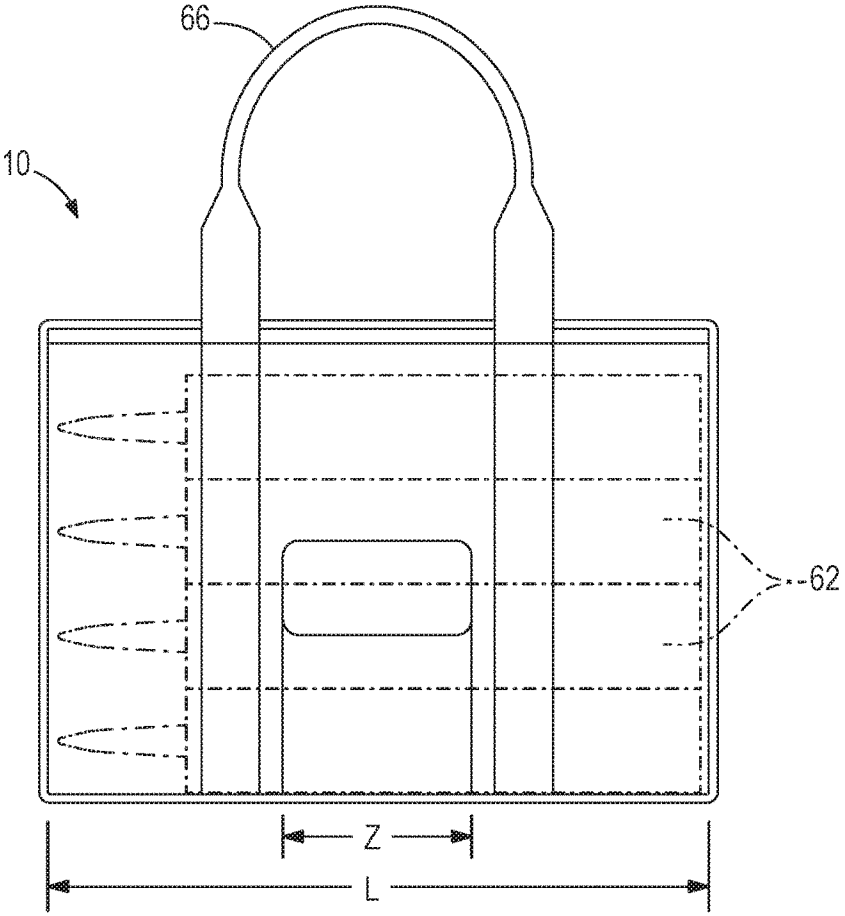
FIG. 3*a* is a schematic front view of the heated utility bag of FIG. 1.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

FIGS. 1-5*b* illustrate a heated utility bag 10 according to one embodiment of the invention. The heated utility bag 10 includes a structure or frame 14 that includes four side walls or panels 18, 22, 26, 30 connected on one end by a bottom wall or panel 34 and on an opposite end by a top wall or panel 38. The top panel 38 and one of the side panels 30 include zippered openings 42, 46. In other embodiments, the zippered openings 42, 46 may be included in any of the side panels 18, 22, 26, 30, bottom panel 34, or top panel 38 and in any combination. The four side panels 18, 22, 26, 30, the bottom panel 34, and the top panel 38 define an opening or cavity 50 therein. The cavity 50 is divided into a first section

54*a* and a second section 54*b* by a central wall 60. The cavity 50 may include fewer or more sections 54*a*, 54*b* and walls than illustrated herein. Each of the first and second sections 54*a*, 54*b* receives items 62. For example, the items 62 may be caulk tubes (as illustrated) or another type of adhesive, material, working tool, etc. to be stored in the utility bag 10. In the embodiment illustrated in FIGS. 1-5*b*, the items 62 are stacked horizontally and the heated utility bag 10 is sized and configured to receive the items 62 horizontally. In other embodiments, the heated utility bag 10 may be sized and configured to receive the items 62 vertically (e.g., see FIGS. 6*a*-9*d*). The heated utility bag 10 also includes first and second handles 66, 70 that are coupled on opposite side panels 18, 26. The handles 66, 70 are preferably formed from nylon and stitched to an outer surface of the opposite side panels 18, 26. However, in other constructions, other suitable materials and attachment may be employed.

Figure 4:
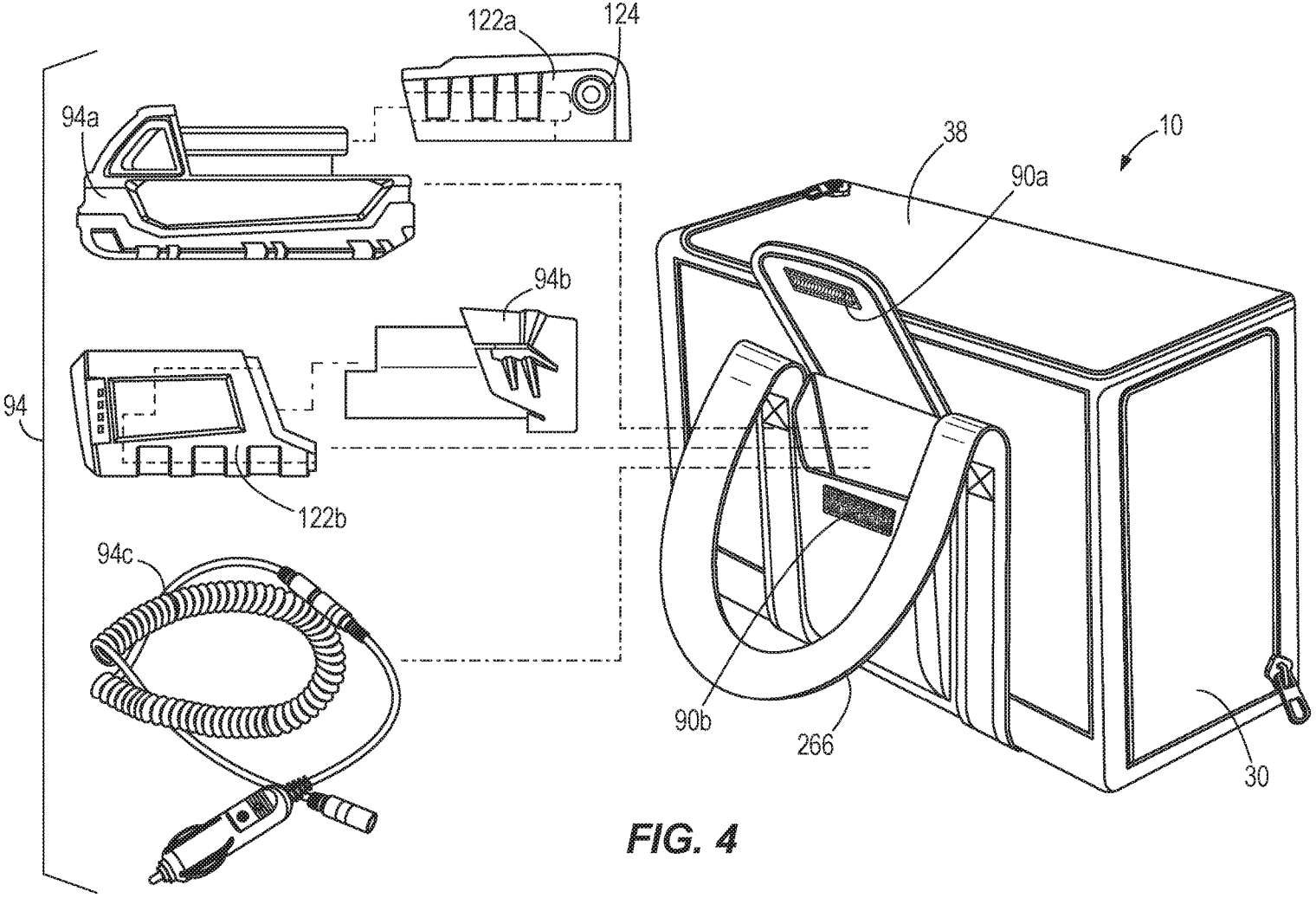
FIG. 4 a perspective view of the heated utility bag of FIG. 1 and a variety of power sources.

One of the side panels 18 includes a control switch 74 and a pocket or receptacle 78 having a pivotable cover 82. The pocket 78 defines a cavity 86 and the cover 82 is removably secured to an outer wall of the pocket 78 to selectively enclose and provide access to the cavity 86. In the illustrated embodiment, the outer wall of the pocket 78 and the cover 82 include mating surfaces 90*a*, 90*b* having a hook-and-loop engagement. Other fastening mechanisms (i.e., snaps and the like) may be employed. The pocket 78 (i.e., cavity 86) removably receives a power source 94*a*, 94*b*, 94*c* (FIG. 4).

The power source 94 communicates with a heating system 98 disposed within cavity 50. Specifically, the heating system 98 is coupled to the central wall 60. In other constructions, the heating system 98 may be coupled to other portions of the utility bag 10, such as the side walls 18, 22, 26, 30, the bottom wall 34 and the top wall 38. The power source 94 provides power to the heating system 98 to warm the bag 10 and the items 62 contained therein, which will be described in greater detail below. The power source 94 may be an 18 volt battery pack 94*a*, a 12 volt battery pack 94*b*, or a DC adapter 94*c*, as illustrated in FIG. 4. However, additional or alternative power sources are contemplated and considered other than those specifically discussed herein. In the illustrated embodiment, the battery pack 94*a* is an eighteen-volt (18V) rechargeable lithium-ion battery pack configured to be received by a power tool, and the battery pack 94*b* is a twelve-volt (12V) rechargeable lithium-ion battery pack configured to be received by a power tool. In other embodiments, other battery packs having other properties may be employed, e.g., a twenty-four-volt (24V) battery pack or other various voltages and compositions.

Figure 5B:
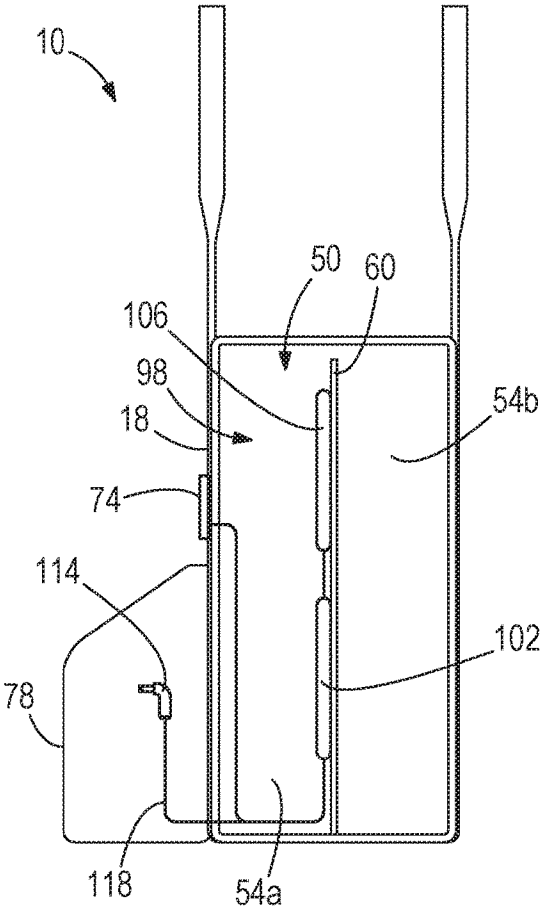
FIG. 5*b* is a side, schematic view of the heated utility bag of FIG. 1 including the heating mechanism FIG. 5*a*.
Figure 5A:
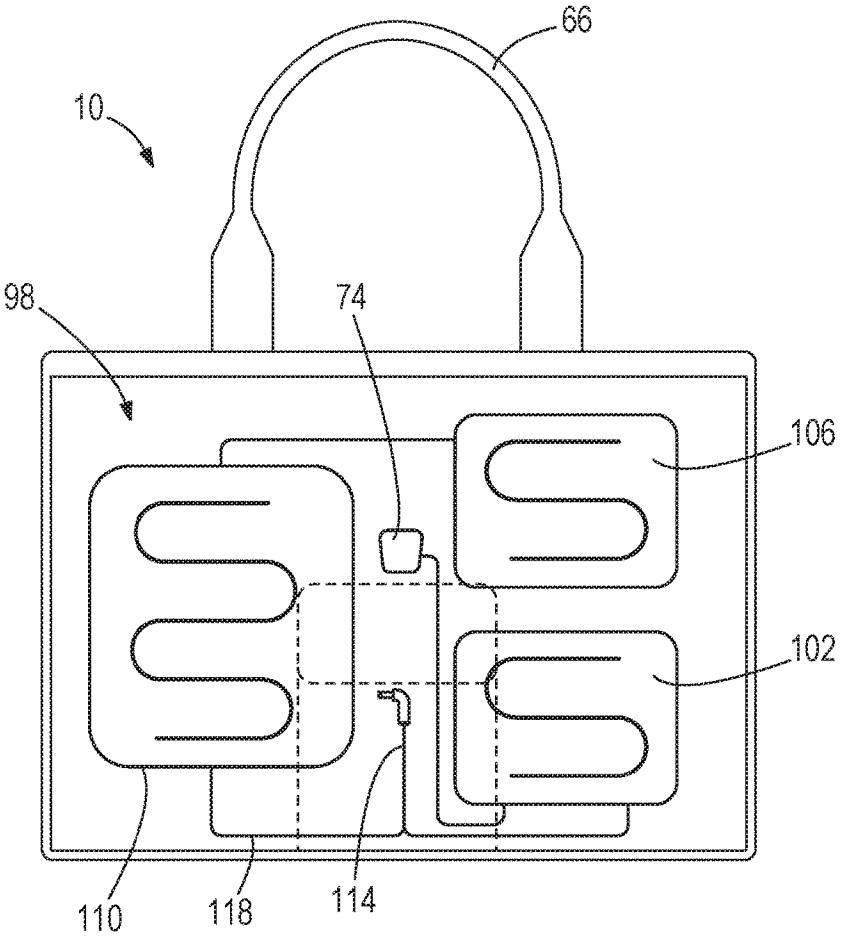
FIG. 5*a* is a front, schematic view of the heated utility bag of FIG. 1 including a heating mechanism.
Figure 6B:
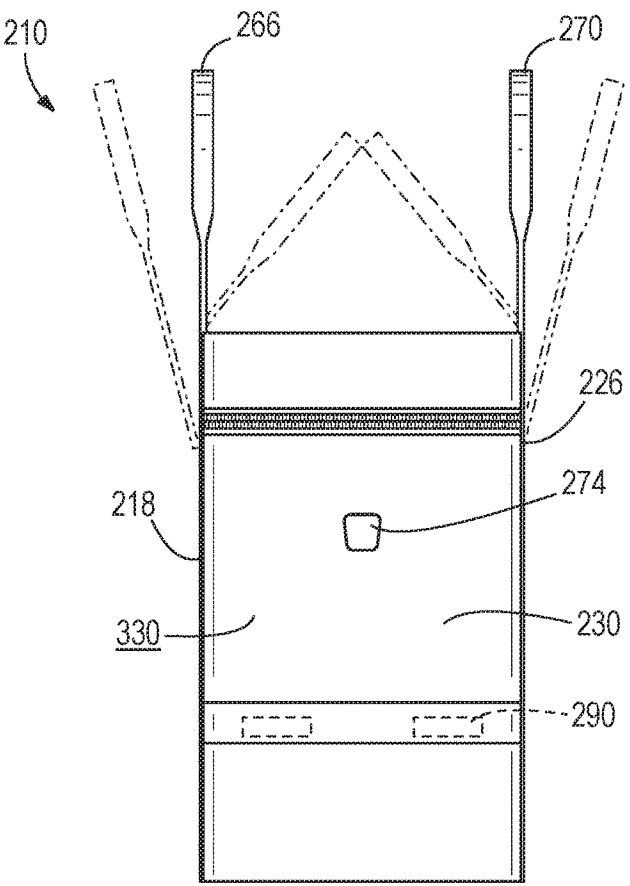
FIG. 6*b* is a side view of the heated utility bag of FIG. 6*a*.
Figure 6A:
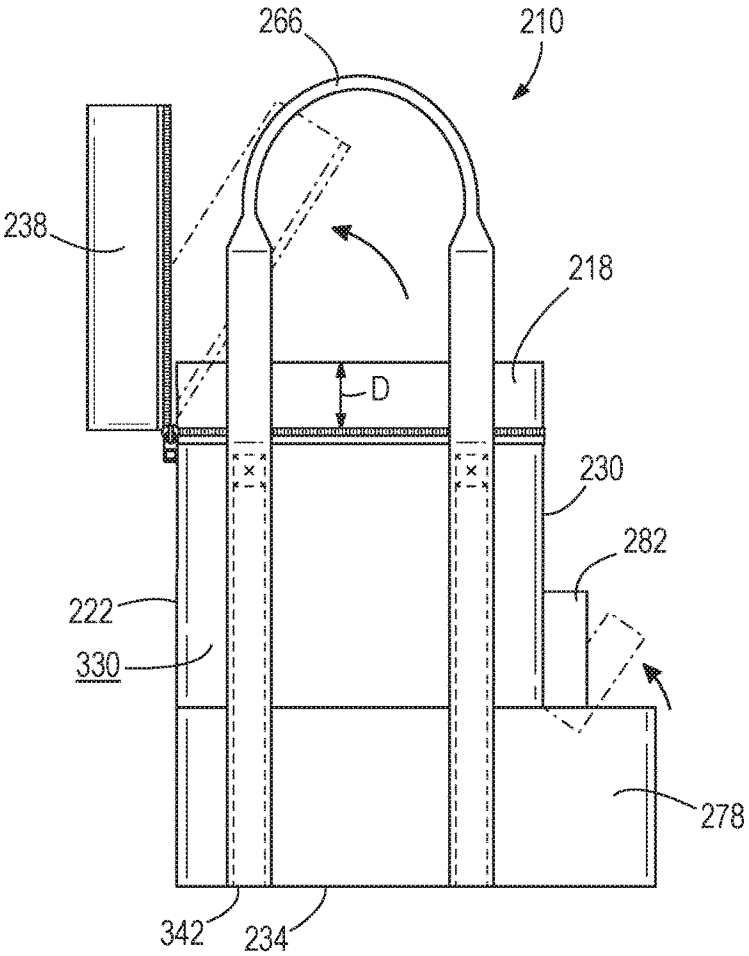
FIG. 6*a* is a front view of a heated utility bag according to another embodiment of the invention.
Figure 7B:
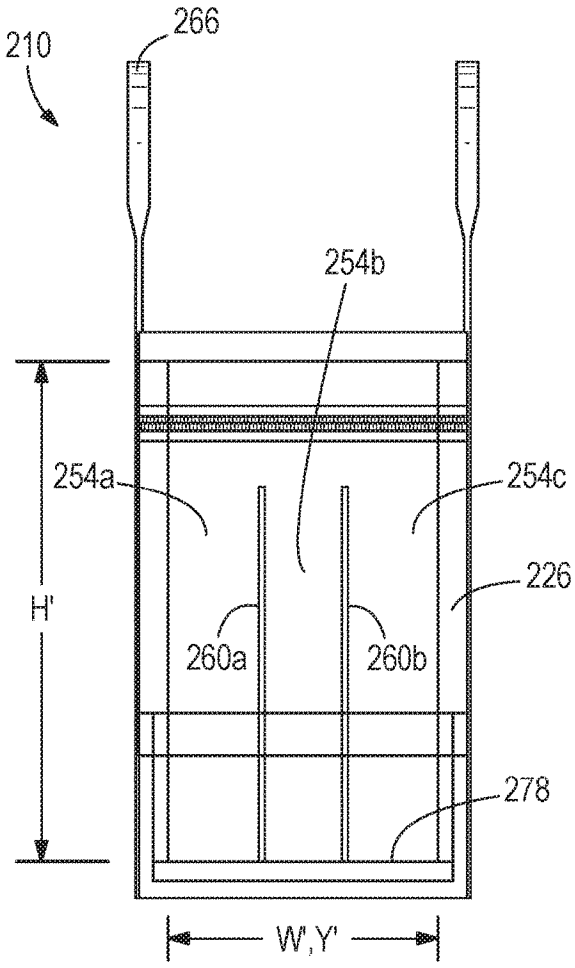
FIG. 7*b* is a side schematic view of the heated utility bag of FIG. 6*b*.
Figure 7A:
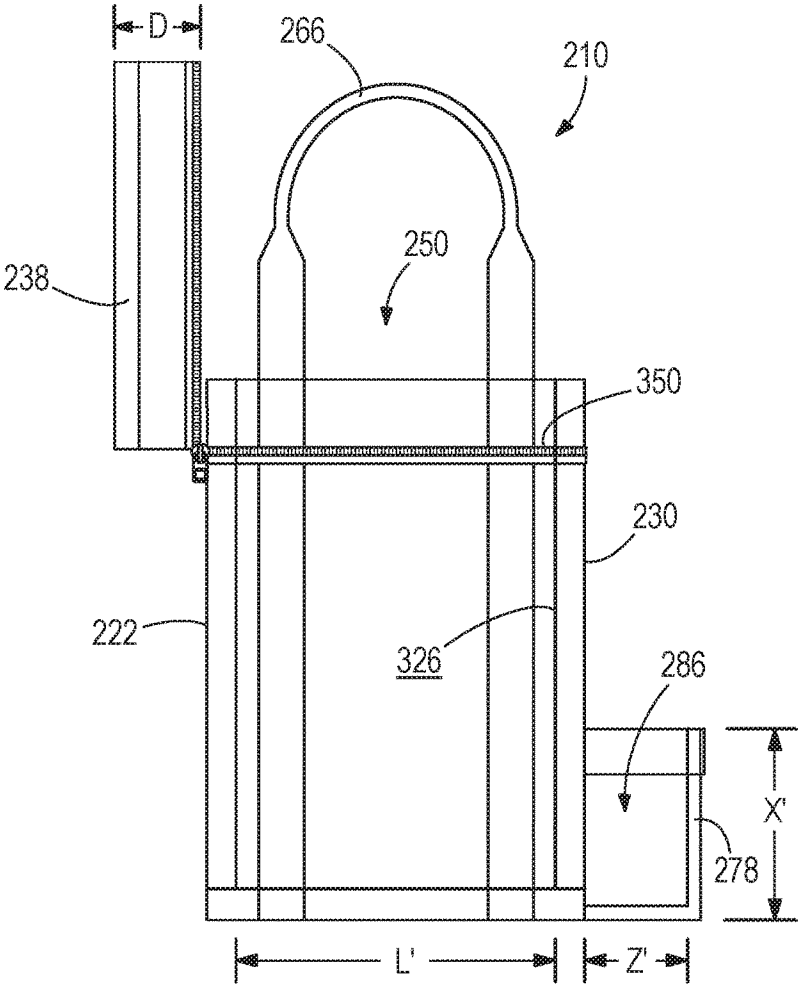
FIG. 7*a* is a front schematic view of the heated utility bag of FIG. 6*a*.
Figure 8B:
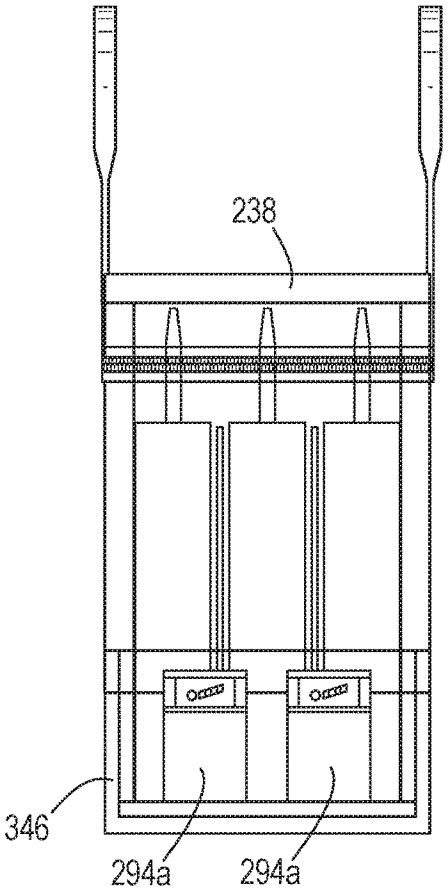
FIG. 8*b* is a schematic side view of the heated utility bag of FIGS. 6*b* and 7*b* showing the power source and caulk tubes.
Figure 8A:
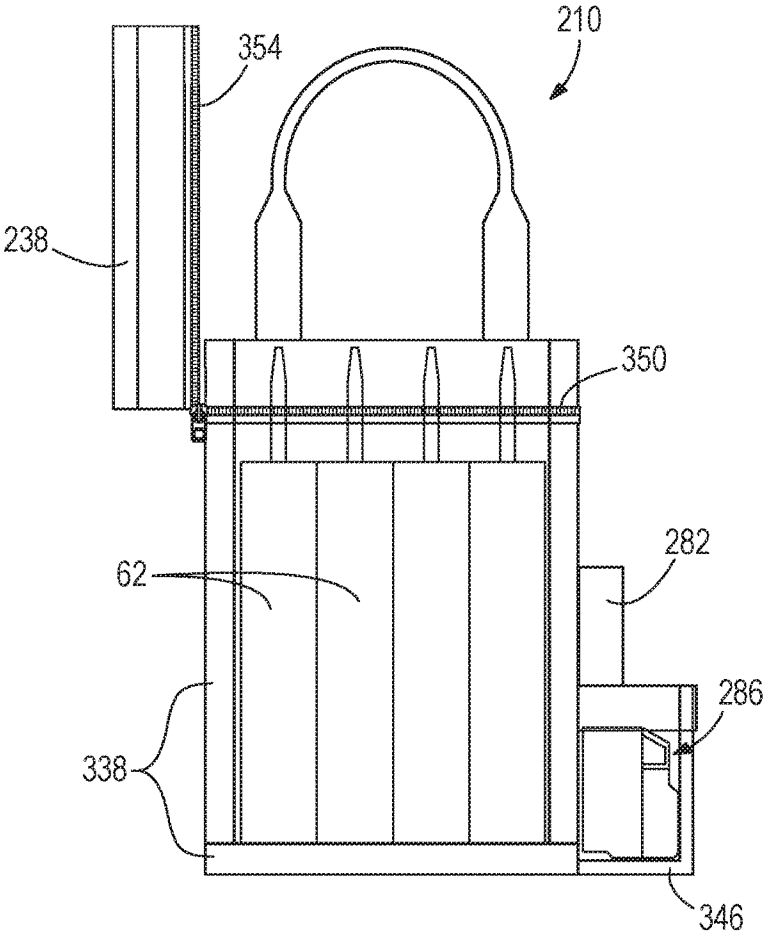
FIG. 8*a* is a schematic front view of the heated utility bag of FIGS. 6*a* and 7*a* showing a power source and caulk tubes.
Figure 9C:
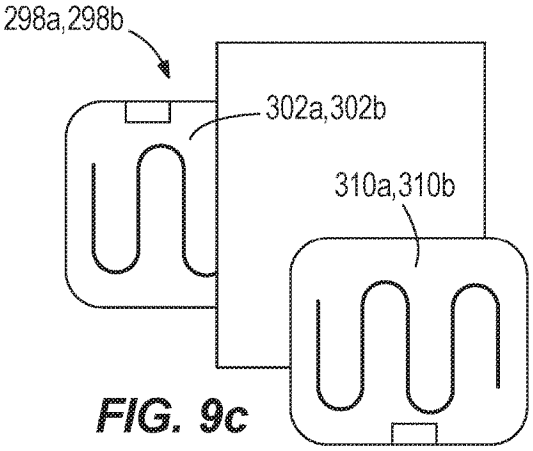
FIG. 9*c* is a schematic view of the heating mechanism of FIG. 9*a*.
Figure 9D:
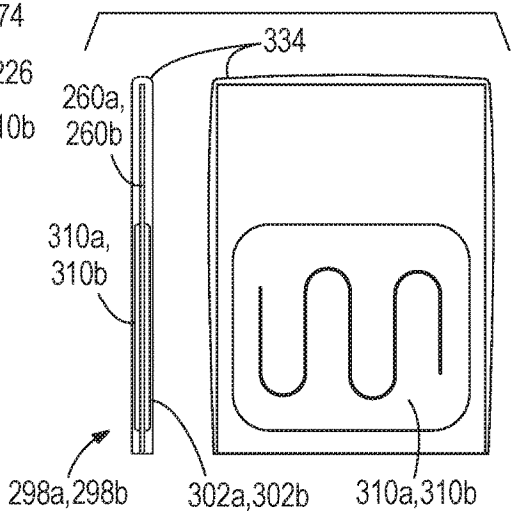
FIG. 9*d* is another view of the heating mechanism of FIG. 9*a*.
Figure 9B:
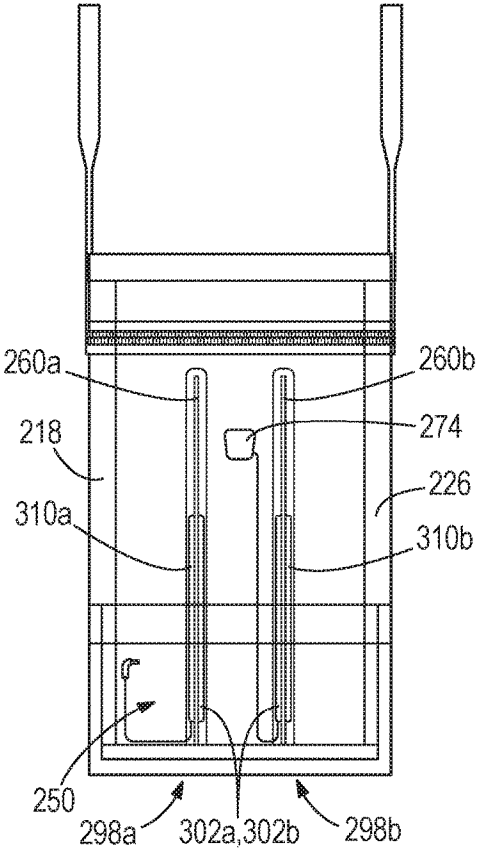
FIG. 9*b* is a side schematic view of the heated utility bag of FIGS. 6*b* and 7*b* and showing the heating mechanism of FIG. 9*a*.
Figure 9A:
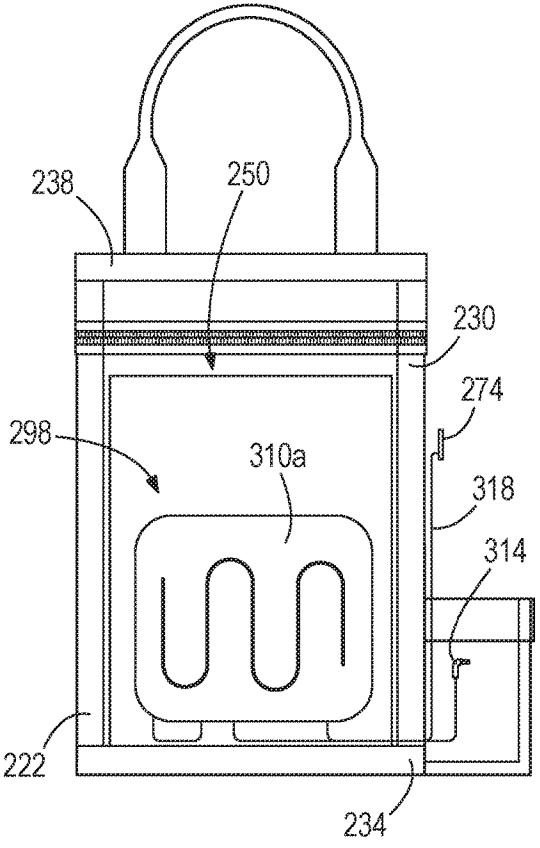
FIG. 9*a* is a front schematic view of the heated utility bag of FIGS. 6*a* and 7*a* showing a heating mechanism.

With reference to FIGS. 5*a*-5*b*, the heating system 98 includes a first heating module 102, a second heating module 106, and a third heating module 110 connected in series, parallel, or a combination thereof. The heating modules 102, 106, 110 are attached to the center wall 60 such that they face the side panel 18 that includes the pocket 78. The heating modules 102, 106, 110 preferably include resistive heating coils formed of carbon fibers and high density carbon fibers. Other heating devices, such as rope type heaters, are also contemplated. In the illustrated embodiment, the first and second heating modules 102, 106 are two watt heaters while the third heating module 110 is a four watt heater. The configurations of the heating modules 102, 106, 110 may take on other configurations and power specifications not specifically discussed herein. The power source 94 communicates with the heating system 98 via the control switch 74 and a plug or jack 114. The jack 114 is electrically coupled to the heating modules 102, 106, 110 by insulated wiring or heater supply cable 118. The insulated wiring 118 extends from the cavity 50 of the bag 10 into the cavity 86 of the pocket 78 through the side wall 18 such that the jack 114 resides in the pocket 78. The insulated wiring 118 has any suitable length such that the jack 114 may be coupled to a variety of power source types.

The heating modules 102, 106, 110 are controlled by a controller 122*a*, 122*b* (FIG. 4), which is in communication with the control switch 74. The control switch 74 may be coupled to a printed circuit board (not shown) within the controller 122*a*, 122*b* and is coupled to the controller 122*a*, 122*b* by plugging the jack 114 into a jack receptacle 124 in the controller 122*a*, 122*b*. The controller 122*a*, 122*b* communicates with the power source 94. The controller 122*a*, 122*b* may be directly coupled to the power source 94, as is illustrated herein, or the controller may be disposed at another location (i.e., in the pocket 78 or an exterior surface of the bag 10). As illustrated in FIG. 4, the controller 122*a*, 122*b* is essentially shaped and sized to correspond with the receptacle of a power tool to which the power source 94 typically attaches. For example, the battery pack 94*a* and the battery pack 94*b* typically attach to a power tool, such as a powered drill or band saw, and the controller 122*a*, 122*b* has the same interface as the power tool has for receiving the battery pack 94*a*, 94*b*. The controller 122*a* slidingly receives the battery pack 94*a*, and the controller 122*b* receives the battery pack 94*b* slidably substantially axially or concentrically therein. The controller 122 may include one or more control modes or settings. For example, the controller 122 includes a first mode or high setting, a second mode or medium setting, and a third mode or low setting. The settings determine how long power is supplied to the heating modules 102, 106, 110. The high setting supplies power to the modules 75% of time. The medium setting supplies power to the modules 50% of the time. The low setting supplies power to the modules 25% of the time. A higher temperature results within the bag 10 as the time that power is supplied to the heating modules 102, 106, 110 increases. Therefore, the high setting is used to heat the bag 10 to a higher temperature than either the medium or low settings. The control switch 74 is used to select between the one or more control modes and an OFF mode in which no power is supplied to the heating system 98.

As illustrated in FIG. 1, the frame 14 and the central wall 60 are constructed of rigid plastic, while the side panels 18, 22, 26, 30, bottom panel 34, and top panel 38 include a first or inner lining 126 constructed from a thermally insulating material and second or outer surface 130 constructed from a nylon material. The heating modules 102, 106, 110 are attached to the central wall 60 and then covered in a nylon material 134. The pocket 78 and cover 82 are preferably constructed from the nylon material used on the outer surface 130. The handles 66, 70 are also preferably constructed from a nylon material. The insulated lining aids in maintaining heat provided by the heating system 98 within the cavity 50. The illustrated insulated lining is preferably a reflective lining, but other types of insulated lining may be employed. The lining is also preferably water-proof and, therefore, cleanable (i.e., in order to remove spills). Additionally, the materials discussed herein are merely exemplary and therefore, the rigid plastic and nylon may be replaced or substituted with other suitable materials.

In the illustrated embodiment, the four side panels 18, 22, 26, 30 together with the bottom panel 34 and top panel 38 define a substantially rectangular box-like structure (i.e., the cavity 50). The sections 54*a*, 54*b* are sized and shaped to receive about eight 28 fl. Oz. items 62, such as caulk tubes.

There are eight items 62 (four in each section 54*a*, 54*b*) illustrated in the embodiment of FIGS. 1-5*b*. Fewer or more items 62 may be accommodated in each of the sections 54*a*, 54*b* depending on the size of the items 62, and the utility bag 10 may be constructed to have specific dimensions for holding a specific quantity of items 62. In the illustrated embodiment, the approximate dimensions of the height H, width W, and length L are approximately 12.0", 5.5", and 17.0", respectively. Additional or alternative embodiments may have other configurations, sizes, or shapes. The pocket 78 illustrated in FIGS. 1-5*a* has a height X, width Y, and length Z of approximately 4.0", 3.5", and 5.0", respectively. In other embodiments, the pocket 78 may include other configurations, sizes and shapes.

In operation, one or more items 62 are placed in the cavity 50. The controller 122*a*, 122*b* is coupled to the power source 94. The pocket 78 receives the controller 122*a*, 122*b* and power source 94 and the jack 114 is coupled to the controller 122*a*, 122*b*. The power source 94 supplies electricity to the controller 122*a*, 122*b* for distribution to the heater modules 102, 106, 110. The operator can selectively heat the utility bag 10 and the items 62 therein by selecting one of the control modes discussed above. The power source 94 is removable to ensure that the bag 10 is not heated unnecessarily (i.e., when the bag 10 is empty) or to replace the power source 94.

FIGS. 6*a*-9*b* illustrate a heated utility bag 210 according to another embodiment of the invention. It is to be understood that various features of the two embodiments may be combined into a single embodiment, and the invention is not limited to one embodiment or the other. The heated utility bag 210 includes four side walls or panels 218, 222, 226, 230 connected on one end by a bottom wall or panel 234 and on an opposite end by a pivotable cover 238. The four side panels 218, 222, 226, 230 and the bottom panel 234 define an opening or cavity 250 therein. Three of the side panels 218, 226, 230 include a first continuous mating interface 350 fixed thereto. The cover 238 is pivotally attached to one of the side panels 222 and includes a second continuous mating interface 354 along three corresponding edges. The first and second mating interfaces 350, 354 cooperate to open and close the cavity 250 and are disposed a distance D (FIG. 7*a*) from a top of the bag 210. The cover 238 is movable between a first or closed position (FIGS. 6*b*, 7*b*, 8*b*, 9*b*) and a second or open position (FIGS. 6*a*, 7*a*, 8*a*, 9*a*). In the first position, the second mating interface 354 is coupled to the first mating interface 350 and therefore, the cavity 250 is inaccessible (i.e., the bag 210 is closed). In the second position, the first and second mating interface 350, 354 are uncoupled such that the cover 238 is pivotable away from the cavity 250 and therefore the cavity 250 is accessible (i.e., the bag 210 is open). The mating interfaces 350, 354 in the illustrated embodiment are zipper interfaces; additional or alternative embodiment may include mating surfaces having any suitable fastening mechanism (i.e., hook-and-loop fasteners and the like).

The cavity 250 is divided into three sections 254*a*, 254*b*, 254*c* by a first wall 260*a* and a second wall 260*b*. Each of the sections 254*a*, 254*b*, 254*c* receives items 62. In the embodiment illustrated in FIGS. 6*a*-9*d*, the items 62 are arranged in rows and are standing in an upright orientation. The cavity 250 may include fewer or more sections 254*a*, 254*b*, 254*c* and walls 260*a*, 260*b* than illustrated herein. The heated utility bag 210 also includes first and second handles 266, 270 that are coupled on opposite side panels 218, 226. The handles 266, 270 are movable relative to the cavity 250 and to one another.

One of the side panels 230 includes a control switch 274 and a pocket 278 or receptacle having a pivotable cover 282. The pocket 278 defines a cavity 286 and the cover 282 is removably secured to an outer wall of the pocket 278 to provide access to the cavity 286. In the illustrated embodiment, the outer wall of the pocket 278 and the cover 282 include mating surfaces 290 having a hook-and-loop engagement. Other fastening mechanisms (i.e., snaps and the like) may be employed. The pocket 278 removably receives at least one power source 294. In the embodiment illustrated in FIGS. 6*a*-9*b*, the pocket 278 is elongated and therefore accommodates a first power source 294*a* and a second power source 294*b*. Additional or alternative embodiments may include a separate pocket for each power source 294*a*, 294*b*. In yet other embodiments, only one power source is employed (e.g., FIGS. 1-5*b*).

With reference to FIGS. 8*a*-9*d*, at least one of the first and second power sources 294*a*, 294*b* communicate with a heating system 298 disposed within the cavity 250. Specifically, the heating system 298 includes a first heater array 298*a* coupled to the first wall 260*a* and a second heater array 298*b* coupled to the second wall 260*b*. In the embodiment illustrated in FIGS. 6*a*-9*d*, only one of the first or second power sources 294*a*, 294*b* communicates with the heating system 298 at a time to warm the bag 210 and the items 62 contained therein, which will be described in greater detail below. The other of the first or second power sources 294*a*, 294*b* may be stored in the pocket 278. It should be understood that the power sources 294*a*, 294*b* are interchangeable. The power sources 294*a*, 294*b* may also include an 18 volt battery pack 94*a*, a 12 volt battery pack 94*b*, a DC adapter 94*c*, as illustrated in FIG. 4. However, additional or alternative power sources 294*a*, 294*b* are contemplated and considered other than those specifically discussed herein. In other embodiments, both of the power sources 294*a*, 294*b* may be connected to the heating system 298. For example, the power source 294*a* may be connected to the first heater array 298*a* and the second power source 294*a* may be connected to the second heater array 298*b*.

Each of the first and second heater arrays 298*a*, 298*b* includes a first heating module 302*a*, 302*b* and a second heating module 310*a*, 310*b* connected in series, parallel or a combination of both. The heating modules 302*a*, 302*b*, 310*a*, 310*b* may include resistive heating coils formed of carbon fibers and high density carbon fibers and other heating devices, such as rope type heaters, are also contemplated. The second heating modules 310*a*, 310*b* are attached to the first and second center walls 260*a*, 260*b* such that they face the side panels 218, 226. The first heating module 302*a* is attached to the first center wall 260*a* such that it faces the second heating module 302*b* that is attached to the second center wall 260*b*. In other words, the second heating modules 310*a*, 310*b* face the first and third sections 254*a*, 254*c*, respectively (away from a center of the cavity 250), while the first heating modules 302*a*, 302*b* face towards the second section 254*b* (a center of the cavity 250). In the illustrated embodiment, the first heating modules 302*a*, 302*b* are two-watt heaters while the second heating modules 310*a*, 310*b* are four-watt heaters. Therefore, the same heating power is provided to each of the first, second and third sections 254*a*, 254*b*, 254*c*. The configurations of the heating modules 302*a*, 302*b*, 310*a*, 310*b* may take on other configurations and power specifications not specifically discussed herein. One or both of the power sources 294*a*, 294*b* communicate with the heating system 298 via the control switch 274 and a plug or jack 314. The jack 314 is electrically coupled to the heating modules 302*a*, 302*b*, 310*a*, 310*b* by insulated wiring or heater supply cable 318. The insulated wiring 318 extends from the cavity 250 of the bag 210 into the cavity 286 of the pocket 278 such that the jack 314 resides in the pocket 278. In the illustrated embodiment, the wiring 318 passes through insulation at a bottom seam between the side panel 230 and the bottom panel 234. The insulated wiring 318 has any suitable length such that jack 314 may be coupled to a variety of power source types.

The first and second heating modules 302*a*, 302*b*, 310*a*, 310*b* of each of the first and second heater arrays 298*a*, 298*b* are controlled by the controller 122*a*, as discussed above, which is in communication with the control switch 274. In other embodiments, other controllers (such as the controller 122*b* shown in FIG. 4) and other power sources (such as the power sources shown in FIG. 4 and alternatives described above) may be employed. The control switch 274 may be coupled to a printed circuit board (not shown) of the controller 122*a*, which may be located within the controller 122*a*. In the illustrated embodiment, the controller 122*a* communicates with the power source 294*a*. The controller 122*a* is directly coupled to the power source 294*a*, as is illustrated herein, or the controller 122*a* may be disposed at another location (i.e., in the pocket 278 or an exterior surface of the bag 210). As illustrated in FIG. 4, the controller 122*a* is essentially shaped and sized to correspond with the receptacle of a power tool to which the power source 294*a* typically attaches. For example, the battery pack 294*a* and the battery pack 294*b* typically attach to a power tool, such as a powered drill or band saw, and the controller 122*a* has the same interface as the power tool has for receiving the battery pack 294*a*, 294*b*. The controller 122*a* slidingly receives the battery pack 294*a*. The controller 122*a*, 122*b* may include one or more control modes or settings. For example, the controller 122*a*, 122*b* includes a first mode or high setting, a second mode or medium setting, and a third mode or low setting. The settings determine how long power is supplied to the heating modules 302*a*, 302*b*, 310*a*, 310*b*. The high setting supplies power to the modules 75% of time. The medium setting supplies power to the modules 50% of the time. The low setting supplies power to the modules 25% of the time. A higher temperature results within the bag 10 as the time that power is supplied to the heating modules 302*a*, 302*b*, 310*a*, 310*b* increases. Therefore, the high setting is used to heat the bag 10 to a higher temperature than either the medium or low settings. The control switch 274 is used to select between the one or more control modes and an OFF mode in which no power is supplied to the heating system 298.

As discussed briefly above, it is contemplated that in some embodiments the first heater array 298*a* is powered by the first power source 294*a* and the second heater array 298*b* is powered by the second power source 294*b*. In these embodiments, the first power source 294*a* communicates with the first heater array 298*a* via a first control switch 274 and a first plug or jack 314. Similarly, the second power source 294*b* communicates with the second heater array 298*b* via a second control switch (not shown) and a second plug or jack (not shown). As such, the first and second jacks are electrically coupled to the heating modules 302*a*, 302*b*, 310*a*, 310*b*, respectively, by first and second insulated wiring or heater supply cables. The insulated wirings extend from the cavity 250 into the one or more pockets 278 such that the first jack 314 and the second jack reside in the one or more pockets 278. The first and second insulated wirings may have any suitable length such that first and second jacks, respectively, may be coupled to a variety of power source types. In these embodiments each of the heater arrays are controlled independently as discussed above with respect to the other embodiments herein. Alternatively, the first and second heater arrays 298*a*, 298*b* may be powered by the first power source 294*a* and the second power source 294*b* and be controlled with a single control switch 274.

As illustrated in FIGS. 6*a*-7*b*, the central walls 260*a*, 260*b* are constructed of rigid plastic, while the side walls 218, 222, 226, 230, bottom wall 234, and the cover 238 include a first or inner surface 326 constructed from an insulated lining and second or outer surface 330 preferably constructed from a nylon material. The side panels 218, 222, 226, 230 and cover 238 are reinforced by foam insulation 338 disposed between the outer and inner surfaces 326, 330. A hard plastic sheet 342 is used to reinforce the bottom panel. The first and second heater arrays 298*a*, 298*b* are attached near the bottom of the first and second central walls 260*a*, 260*b*, respectively, and then covered in a material 334 (FIG. 9*d*), preferably nylon. The pocket 278 and pocket cover 282 are constructed from the nylon material used on the outer surface 330. The pocket 278 is reinforced with foam insulation 346 on the inner surfaces. The handles 266, 270 are preferably constructed from a nylon material as well. The insulated lining aids in maintaining heat provided by the heating system 298 within the cavity 250. The illustrated insulated lining is a reflective lining, but other types of insulated lining may be employed. The lining is also preferably water-proof and therefore, cleanable (i.e., in order to remove spills). Additionally, the materials discussed herein are merely exemplary and therefore, the rigid plastic and nylon may be replaced or substituted with other suitable materials.

In the illustrated embodiment of FIGS. 6*a*-9*d*, the four side panels 218, 222, 226, 230 together with the bottom panel 234 and cover 238 define a substantially rectangular box-like structure. The sections 254*a*, 254*b*, 254*c* are sized and shaped to receive approximately twelve 28 fl. Oz. items 62, such as caulk tubes. There are twelve items 62 (four in each section) illustrated in the embodiment of FIGS. 6*a*-9*d*. Fewer or more items 62 may be accommodated in each of the sections 254*a*, 254*b*, 254*c* depending on the size of the items 62. In the illustrated embodiment, the dimensions of the height H', width W', and length L' are approximately 17.0 inches, 9.75 inches, and 10.5 inches, respectively. Additional or alternative embodiments may include structures having other configurations, sizes, or shapes, as discussed above. The pocket 278 illustrated in FIGS. 6*a*-9*b* has a height X', width Y', and length Z' of approximately 5.5 inches, 9.75 inches, and 3.5 inches, respectively. The pocket 278 may include other configurations, sizes and shapes in additional or alternative embodiments.

In operation, one or more items 62 are placed in the sections 254*a*, 254*b*, 254*c* of the cavity 250. The controller 122*a* is coupled to the power source 294*a*. The pocket 278 receives the controller 122*a* and power source 294*a* such that the jack 314 (or jacks) may be coupled to the controller 122*a*, as described above. The power source 294*a* supplies electricity to the heater control module within the controller 122*a* for distribution to the heater modules 302*a*, 302*b*, 310*a*, 310*b*. The operator can selectively heat the utility bag 210 and the items 62 therein by selecting one of the control modes discussed above. The power source is removable to ensure that the bag 210 is not heated unnecessarily (i.e., when the bag 210 is empty) or to replace the power supply 294*a*.

While multiple embodiments are shown and described herein, it should be understood that features of each embodiment may be used in any other embodiment. Therefore, features described with respect to one embodiment may be used additionally or alternatively to the features of any of the other embodiments disclosed herein.

Thus, the invention provides, among other things, a heated utility bag including a heating system for warming an item, such as a caulk tube. Although the invention has been described in detail with reference to certain preferred embodiments, variations and modifications exist within the scope and spirit of one or more independent aspects of the invention.

What is claimed is:

1. A utility bag comprising:

a frame defining an interior and an exterior, the interior including a first cavity configured to receive an item;

a heater element disposed in the first cavity;

a power tool battery pack in electrical communication with the heater element for powering the heater element, wherein the power tool battery pack includes an interface that is substantially shaped and sized to be mechanically and electrically coupled to a power tool battery receptacle;

a controller for distributing power from the power tool battery pack to the heater element in a plurality of modes, wherein the controller includes an interface that is substantially shaped and sized for mechanically and electrically mating with the power tool battery pack; and a pocket coupled to the frame, the pocket defining a second cavity configured to receive the power tool battery pack.

2. The utility bag of claim 1, further comprising at least one wall dividing the first cavity into a plurality of sections.

3. The utility bag of claim 2, wherein the heater element is coupled to the at least one wall.

4. The utility bag of claim 1, wherein the pocket is disposed exterior of the frame.

5. The utility bag of claim 4, wherein the pocket includes a cover coupled to the pocket for selectively opening and closing the pocket for inserting and removing the power tool battery pack.

6. The utility bag of claim 1, wherein the interface is configured to rigidly and removably fix the battery pack directly with the power tool.

7. The utility bag of claim 1, wherein the plurality of modes include a low heat mode, a medium heat mode, and a high heat mode, wherein power is supplied to the heater element for a predetermined percentage of time in each mode.

8. The utility bag of claim 1, further comprising a control switch for selecting between one or more control modes, wherein the control switch is coupled to the controller.

9. The utility bag of claim 8, wherein the control switch is disposed on the frame.

10. The utility bag of claim 9, wherein the controller includes a jack receptacle, wherein the control switch is coupled to the controller by way of a wire and a jack received in the jack receptacle.

11. The utility bag of claim 1, wherein the controller is slidingly received by the power tool battery pack.

12. The utility bag of claim 11, wherein the controller and the power tool battery pack are disposed in the pocket.

13. The utility bag of claim 1, wherein the controller includes a jack receptacle.

14. The utility bag of claim 1, wherein the frame includes a plurality of side panels, wherein the utility bag further comprises a handle coupled to at least one of the plurality of side panels.

15. A utility bag comprising:

a frame defining an interior and an exterior, the interior including a cavity configured to receive an item;

a heater element disposed in the cavity;

a battery pack in electrical communication with the heater element for powering the heater element;

a controller removably coupled to the battery pack, wherein the controller is shaped and sized to mechanically and electrically mate with the battery pack; and a pocket coupled to the frame, the pocket defining a second cavity configured to receive the battery.

16. The utility bag of claim 15, wherein the battery pack includes a power tool battery pack shaped and sized to mechanically and electrically mate with a power tool, and wherein the power tool battery pack is interchangeably coupleable with the controller and the power tool.

17. The utility bag of claim 16, wherein the controller is configured for distributing power from the power tool battery pack to the heater element in a plurality of modes.

18. A utility bag comprising:

a frame defining an interior and an exterior, the interior including a first cavity configured to receive an item;

at least one wall dividing the cavity into a plurality of sections;

a heater element disposed in the cavity and coupled to the at least one wall;

a power tool battery pack in electrical communication with the heater element for powering the heater element, the power tool battery pack including an interface that is substantially shaped and sized to be mechanically and electrically coupled to a power tool;

a controller configured to distribute power from the power tool battery pack to the heater element in a plurality of modes, wherein the controller is shaped and sized to mechanically and electrically mate with the power tool battery pack, wherein the controller includes a jack receptacle;

a control switch for selecting between the plurality of modes, wherein the control switch is coupled to the controller by way of a jack received in the jack receptacle, wherein the control switch is disposed on the frame; and a pocket coupled to the frame and disposed exterior of the frame, the pocket defining a second cavity configured to receive the power tool battery pack and the controller.

* * * * *